United States Patent [19]

Frantzen

[11] 4,236,357

[45] Dec. 2, 1980

[54] ETCHED METAL ABRASIVES

[75] Inventor: John J. Frantzen, Roseville, Minn.

[73] Assignee: Minnesota Micro Metal, Inc., St. Paul, Minn.

[21] Appl. No.: 37,391

[22] Filed: May 8, 1979

[51] Int. Cl.[2] ..... B24D 3/06

[52] U.S. Cl. ..... 51/309; 51/293

[58] Field of Search ..... 51/293, 309, DIG. 30

[56] References Cited

U.S. PATENT DOCUMENTS

| | | | |
|---|---|---|---|
| 2,541,658 | 2/1951 | Masin | 51/309 |
| 3,045,321 | 7/1962 | McDermott | 29/78 |
| 4,078,906 | 3/1978 | Green | 51/309 |
| 4,097,636 | 6/1978 | Hawrylo et al. | 51/309 |
| 4,099,935 | 7/1978 | Bond et al. | 51/309 |

*Primary Examiner*—Donald J. Arnold
*Assistant Examiner*—W. Thompson
*Attorney, Agent, or Firm*—Neil B. Schulte

[57] ABSTRACT

An etched metal abrasive formed from a laminated sheet of steel having a top layer of high carbon steel and a base layer of low carbon steel.

2 Claims, 4 Drawing Figures

ETCHED METAL ABRASIVES

BACKGROUND OF THE INVENTION

This invention comprises an improvement to prior art etched metal abrasives as exemplified by my co-pending U.S. Pat. application Ser. No. 934,206 filed Aug. 16, 1978 for "Abrading Material and Method of Making Same". My earlier filed patent discloses the process for removing a major portion of the surface of a sheet of metal by etching and leaving only small portions of the surface to form sharp cutting protrusions. These protrusions are then hardened by heat treating so as to create a durable long-lasting abrasive.

SUMMARY OF THE INVENTION

Briefly, the present invention contemplates beginning the process described above with a laminated sheet of metal having a top layer of high carbon steel and a bottom layer of low carbon steel. A suitable etching resist pattern is applied to the top layer to create a large number of small more or less randomly distributed resist elements to protect the eventual cutting points. The remainder of the high carbon steel is then etched away leaving a multiplicity of high carbon steel protrusions extending outward from a low carbon steel base. In this configuration the hardening treatment is much more effective in that the high carbon steel is easily hardened to provide sharp cutting edges and points while the low carbon steel base remains strong and flexible. Consequently, the cutting protrusions are less likely to be forcibly detached from the base during high speed impact such as could be encountered when the abrasive is being used with a machine driven tool or on a particularly hard working surface. Thus, it may be seen that it is an object of my invention to provide a novel method of producing abrasive materials and a new and novel etched metal abrasive itself. It is a further object of my invention to provide an etched metal abrasive which is durable and longer lasting than any heretofore known. Further objects and advantages will become apparent upon consideration of the following detailed description and drawings.

DESCRIPTION OF THE PREFERRED EMBODIMENT

Figure 1:
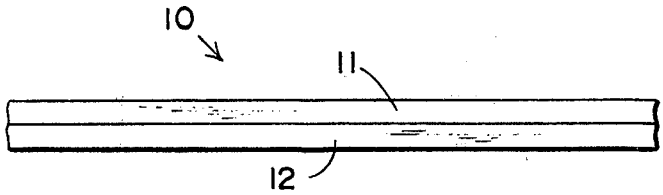
FIG. 1 is an elevational view showing a portion of the laminated metal used in the invention.

The abrasive is produced from a metal laminate 10, as shown in FIG. 1, having a base layer 11 comprising a low carbon steel and a top layer 12 comprising a relatively high carbon steel. Such laminates are well know to those skilled in the art and readily available from steel manufacturers.

Figure 2:
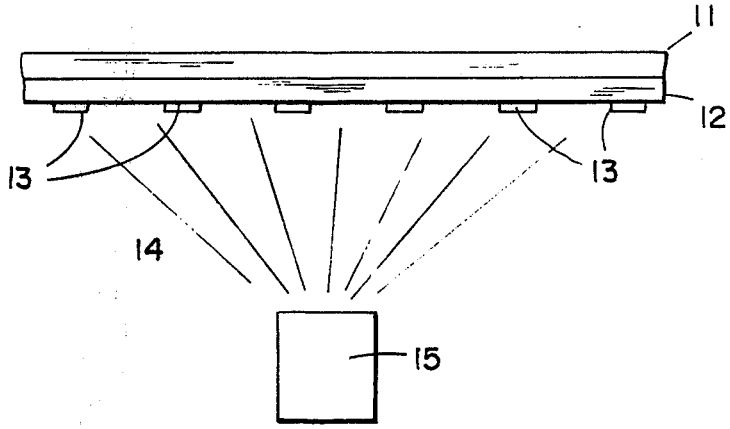
FIGS. 2 and 3 show subsequent production steps in creating the etched metal abrasive.
Figure 3:
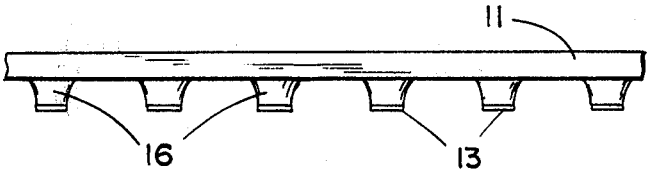
Figure 4:
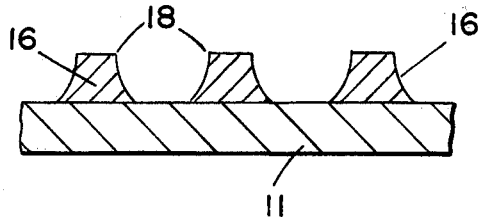
FIG. 4 is a sectional view of a fragmentary portion of the abrasive showing the resultant cutting protrusions and their hardened surfaces.

As shown in FIG. 2, the abrasive is created by applying a multiplicity of small islands of resist 13 to the layer 12 and spraying the remainder of layer 12 with an etching spray 14 from a nozzle 15 in a manner well known to those skilled in the art. Most of the high carbon steel layer 12 is etched away except for those areas under the resist elements 13 producing the abrasive material shown in FIG. 3. A large number of high carbon steel protrusions 16 remain bonded to the low carbon steel base 11. The abrasive is completed by chemically removing the etchant resist 13 and hardening the metal abrasive with the heat treatment so as to create the structure shown in FIG. 4. The hardening process makes each cutting tooth 16 hard while leaving the low carbon steel base 11 relatively flexible and tough. Thus, sharp cutting edges 18 can be realized without making the base layer 11 so brittle that the entire protrusion 16 can be broken loose therefrom during heavy use.

Specific patterns for the resist and the sizes utilized in producing this product can be seen by reference to the prior co-pending patent application mentioned earlier. The subject matter of that application is specifically incorporated herein by reference.

I claim:

1. A method of forming abrasive material comprising the steps of:

applying an etching resist material to the surface of a smooth metal laminate sheet having a relatively low carbon steel base layer and a relatively high carbon steel top layer, said resist material being applied as a multiplicity of discreet elements on said top layer, etching away the said top layer in the areas not protected by the elements of resist so as to leave protrusions of high carbon steel extending outward from said low carbon base layer, removing the etching resist material, and hardening said protrusions by heat treating the protrusions.

2. An abrading material comprising a multiplicity of hardened high carbon steel protrusions extending outward from a low carbon steel base sheet, said protrusions formed by etching away a layer of higher carbon steel laminated to said base sheet in all areas except those protected by a multiplicity of elements of etching resistant material.

* * * * *